US010424278B2

(12) United States Patent
Hillis

(10) Patent No.: US 10,424,278 B2
(45) Date of Patent: Sep. 24, 2019

(54) BELL WITH SUBHARMONIC DIFFERENCE TONE

(71) Applicant: Applied Invention, LLC, Burbank, CA (US)

(72) Inventor: W. Daniel Hillis, Toluca Lake, CA (US)

(73) Assignee: Applied Invention, LLC, Burbank, CA (US)

( * ) Notice: Subject to any disclaimer, the term of this patent is extended or adjusted under 35 U.S.C. 154(b) by 36 days.

(21) Appl. No.: 15/666,867

(22) Filed: Aug. 2, 2017

(65) Prior Publication Data

US 2019/0043461 A1 Feb. 7, 2019

(51) Int. Cl.
*G10D 13/08* (2006.01)
*G10K 1/10* (2006.01)

(52) U.S. Cl.
CPC ..... *G10D 13/08* (2013.01); *G10K 1/10* (2013.01)

(58) Field of Classification Search
CPC ..... G10D 13/08
USPC ..... 84/406
See application file for complete search history.

(56) References Cited

U.S. PATENT DOCUMENTS 2,250,104 A * 7/1941 Morrison ..... H03C 3/04 332/126
2,599,206 A * 6/1952 Smith ..... H03H 11/26 315/13.11
3,253,574 A * 5/1966 Malta ..... G10K 1/071 116/171
3,589,233 A * 6/1971 Rowe, Sr. ..... G10D 13/08 84/402
4,566,400 A * 1/1986 Keenan ..... G10K 1/072 116/149
5,504,270 A * 4/1996 Sethares ..... G10H 1/0066 84/645

(Continued)

OTHER PUBLICATIONS

"PHYSCLIPS, Tartini tones, consonance and temperament, UNSW School of Physics, Sydney, Australia, Wayback web archive, Feb. 7, 2011, https://web.archive.org/web/20110207080656/http://www.animations.physics.unsw.edu.au/jw/Tartini-tones-temperament.html" (Year: 2011).*

(Continued)

*Primary Examiner* — David S Warren
*Assistant Examiner* — Christina M Schreiber
(74) *Attorney, Agent, or Firm* — Michael A. Glenn; Perkins Coie LLP

(57) ABSTRACT

A bell and method of tuning a bell with its lowest frequency partials at $f_1$=f and $f_2$=3f=2. The simultaneous presence of physical tones at these partial frequencies yields a difference tone, perceived by the listener, at $f_2$ ⊟ $f_1$=3f=2 ⊟ f=f=2. The difference tone is subharmonic, in that its perceived frequency (f=2) is below the frequency of the fundamental (f). Preferably, the bell has one or more additional partials at frequencies $f_n$=(n+1)f=2, with n 2 f3; 4; 5: : : g, strengthening the listener's perception of the difference tone at f=2. The bell thus yields a strike tone at f=2 but has a characteristic dimension (e.g. height or diameter) equal to that of conventional bells with a strike tone at f, providing art eightfold savings in bell mass.

10 Claims, 1 Drawing Sheet

(56) References Cited

U.S. PATENT DOCUMENTS

| | | | | |
|---|---|---|---|---|
| 5,523,058 | A * | 6/1996 | Umemura | A61N 7/02 134/1 |
| 6,915,756 | B1 * | 7/2005 | McLachlan | G10K 1/071 116/148 |
| 8,299,343 | B2 * | 10/2012 | Copeland | G10D 13/08 84/411 R |
| 2008/0238628 | A1 * | 10/2008 | Lam | H03B 19/00 340/10.3 |
| 2012/0304846 | A1 * | 12/2012 | McLachlan | G10K 1/063 84/406 |
| 2016/0015953 | A1 * | 1/2016 | Silberg | A61M 37/0092 604/22 |
| 2019/0043461 | A1 * | 2/2019 | Hillis | G10K 1/10 |

OTHER PUBLICATIONS

"Music Acoustics, Tartini tones and temperament: an introduction for musicians, UNSW the University New South Wales, Sydney, Australia, Wayback web archive, Feb. 18, 2015, https://web.archive.org/web/20150218173731/https://newt.phys.unsw.edu.au/jw/tartini-temperament.html" (Year: 2015).*

* cited by examiner

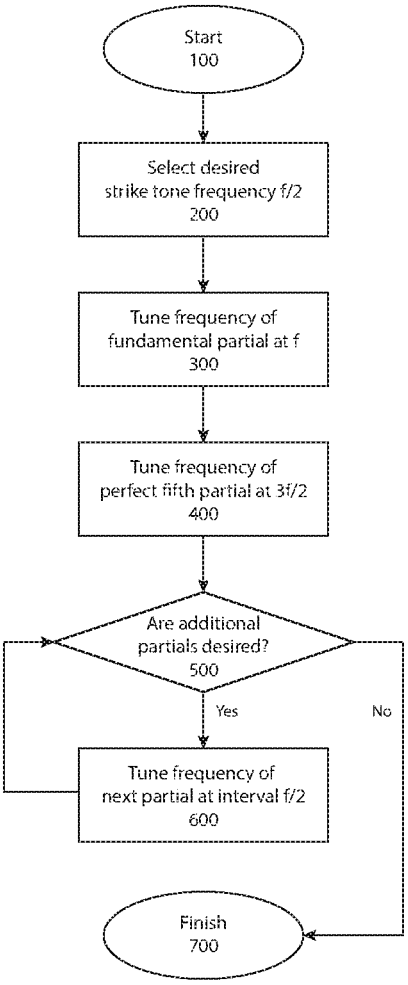
Start
100
Select desired
strike tone frequency f/2
200
Tune frequency of
fundamental partial at f
300
Tune frequency of
perfect fifth partial at 3f/2
400
Are additional
partials desired?
500
Yes
No
Tune frequency of
next partial at interval f/2
600
Finish
700

BELL WITH SUBHARMONIC DIFFERENCE TONE

BACKGROUND

Technical Field

The invention relates to bells, in particular to the design of relatively compact bells capable of producing low frequency tones.

Description of the Related Art

A combination is a psychoacoustic effect in which a listener perceives a tone that is not physically present but instead arises from the simultaneous presence of two real tones.[1] While many classes of combination tones have been theorized and documented, the most readily observed are difference tones, in which a tone of frequency $f_2-f_1$ is perceived in the presence of simultaneously-sounded pure tones of frequency $f_1$ and $f_2$. While Georg Sorge may have been first to describe this effect in writing in 1748,[2] the discovery of difference tones is widely credited to Baroque composer and violinist Giuseppe Tartini. Accordingly, difference tones are often referred to "Tartini tones".

[1]https://en.wikipidea.org/wiki/Combination_tone

[2]Beyer, Robert T. *Sounds of One Times: Two Hundred Years of Acoustics,* 1999, p. 20.

The precise physics underpinning combination tones remain subject to debate. In the latter half of the eighteenth century, several physicists speculated that a difference tone is a beat frequency that, for large enough differences ($f_1-f_2$) in the physical tones, was itself tonally perceived.[3] In subsequent years, this explanation fell out of favor, in part because it failed to explain the often-observed fact that difference tones occur only when the pure tones are sounded at sufficient amplitude. Hermann von Helmholtz, who is generally credited with coining the term difference tone, rejected the beat frequency theory and instead suggested that combination tones generally (and difference tones in particular) arose from a nonlinear response of mechanical components in the human hearing system. In particular, Helmholtz reasoned that while a linear model of the human hearing system remains valid for small amplitude motions, at large enough amplitudes, a non-linens term in the governing equations (proportional to the square of the displacement of the tympanic membrane) would become significant. Referring to the asymmetry associated with the middle ear ossicles[4] interior to the tympanic membrane, Helmholtz "put forward the conjecture that it is the characteristic form of the tympanum that determines the formation of combination tones".[5]

[3]Beyer, Robert T. *Sounds of Our Times: Two Hundred Years of Acoustics,* 1999, p. 20.

[4]Hiebert, Edwin. *The Helmholtz Legacy in Physiological Acoustics,* 2014, p. 36.

[5]von Helmholtz, Hermann. *Ueber Combinationstone,* 1956, p. 261-262.

Combination tones are known to play an important role in the perceived sound of a bell when struck. Like most musical instruments, a typical bell exhibits multiple distinct normal modes of vibration, and a distinct tone is associated with each mode. Each such tone is referred to as a partial. The partials present immediately after the strike include inharmonic tones arising from modes of vibration with motion along or within the surface of the bell. These vibrations decay rapidly, and soon the sound of the bell is dominated by tones arising from vibrational modes where motion occurs perpendicular to the surface of the bell.[6] In a conventionally tuned bell, several of the partials associated with these more persistent tones fall in a harmonic series, and the perceived tone of a bell generally depends on the spacing, relative intensity, and continued persistence of these harmonic partials after striking.

Significant partials within this harmonic series include the fundamental (or prime) of frequency f, the octave (or nominal) at 2f, the twelfth (or upper fifth) at 3f, and the double octave (or upper octave) at 4f. The dominant tone perceived by a listener, termed the strike tone, coincides with the prime for most listeners. However, analysis of a bell's frequency spectrum reveals that the prime partial physically exists only weakly.[7] The dominance of the strike tone for a listener is attributed to the difference tone of frequency $f_3-f_2=3f-2f=f$ between the twelfth and the octave. The presence of the upper octave creates et another difference tone of frequency $f_4-f_3=4f=3f=f$ that enhances the effect. "The ear assumes these to be partials of a missing fundamental, which it hears as the strike note."[8]

[6]Fletcher, Neville H. and Thomas Rossing. *The Physics of Musical Instruments,* 2008, pp. 676-682.

[7]http://en.wikipedia.org/wiki/Strike_tone

[8]Fletcher, Neville H. and Thomas Rossing. *The Physics of Musical Instruments,* 2008, p. 682.

In many bells, the prime (if ever present), the octave, and the twelfth will also decay more more rapidly than the lowest frequency partial present, known as the hum tone, of frequency f/2. "Finally, as the sound of the bell ebbs, the slowly decaying hum tone al octave below the prime . . . ) lingers on."[9] However, for most listeners, the persistence of the lower frequency hum tone does not alter the initial and dominant perception the bell's tone that of the strike tone at the prime frequency f.

[9]Fletcher, Neville H. and Thomas Rossing. *The Physics of Musical Instruments,* 2008, p. 682.

Many applications demand the production of bells producing a deep (i.e. low frequency) strike tone. However, manufacturing bells capable of producing ever deeper strike tones requires increasingly larger amounts of material. If producing a strike tone of frequency generally requires a bell of characteristic dimension (e.g. height or diameter)) then halving the strike tone to frequency $f'=f/2=f/2$ will generally require a bell of characteristic dimension of $L'=2L$. Because the mass of a bell scales as $M\sim L^3$, the amount of material (and cost of manufacture) increases eightfold for each halving of the strike tone frequency. It would be advantageous to devise a bell design that produces deep tones with smaller characteristic dimensions and correspondingly less material.

SUMMARY

The invention is a bell and method of tuning a bell with its lowest frequency partials at $f_1=f$ and $f_2 3f/2$. The simultaneous presence of physical tones at these partial frequencies yields a difference tone, perceived by the listener, at $f_2-f_2=3f/2-f=f/2$. The difference tone is subharmonic, in that its perceived frequency (f/2) is below the frequency of the fundamental (f). Preferably, the bell has one or more additional partials at frequencies $f_n=(n+1)f/2$, with $n\in\{3, 4, 5, \ldots\}$, strengthening the listener's perception of the difference tone at f/2. The bell thus yields a strike tone at f/2 but has a characteristic dimension (e.g. height or diameter) equal to that of conventional bells with a strike tone at f, providing an eightfold savings in bell mass.

The precise size and shape of the bell is tuned to yield vibrational modes generating partials of the desired frequencies. In the preferred embodiment of the invention, the lowest partial is generated by the (2, 0) mode of vibration of the bell and the second-lowest partial is generated by the (3, 0) mode of vibration of the bell. In the preferred embodiment of the invention, the bell is tuned using an iterative optimization procedure in which the frequencies of the vibrational modes of each candidate design are calculated using a finite element analysis.

BRIEF DESCRIPTION OF THE DRAWINGS

FIG. 1 shows a flowchart summarizing a method for tuning a bell with a subharmonic difference tone according to a preferred embodiment of the invention according to a preferred embodiment of the invention.

DETAILED DESCRIPTION

The invention is a bell and method of tuning a bell with its lowest frequency partials at $f_1=f$ and $f_2=3f/2$. The simultaneous presence of physical tones at these partial frequencies yields a difference tone, perceived by the listener, at $f_2-f_1=3f/2-f=f/2$. The difference tone is subharmonic, in that its perceived frequency (f/2) is below the frequency of the fundamental (f). Preferably, the bell has one or more additional partials at frequencies $f_n=(n+1f/2$, with $n\in\{3, 4, 5 \ldots\}$, strengthening the listener's perception of the difference tone at f/2. The bell thus yields a strike tone at f/2 but has a characteristic dimension (e.g. height or diameter) equal to that of conventional bells with a strike tone at f, providing an eightfold savings in bell mass.

The design of the bell differs from conventional bells with (as described above) a "missing fundamental" and a hum tone below the missing fundamental. Rather, the present bell may be described as having a "missing hum", a strong fundamental, and a strong perfect fifth. Preferably, the bell also has an octave and additional partials at frequencies spaced at an interval of f/2. Preferably, the fundamental, perfect fifth, and higher frequency partials sound simultaneously upon strike and persist for as long as possible after strike.

FIG. 1 shows a flowchart summarizing a method for tuning a bell with a subharmonic difference tone according to a preferred embodiment of the invention according to a preferred embodiment of the invention. To perform the method, a bell designer begins 100 by choosing 200 a desired strike tone frequency f/2. The designer then tunes 300 the frequency of the lowest, fundamental partial at frequency f and tunes 400 the frequency of the second-lowest, perfect fifth partial at frequency 3f/2. If additional partials 500 are not desired, the designer finishes 700. If additional partials are desired, the designer tunes the frequency of the next partial at frequency interval of f/2 above the previous partial 600. The designer then considers whether additional partials are desired.

The method of FIG. 1 yields a sequence of frequencies $\{f_0, f_1, f_2 \ldots f_n\}$, where $f_0$ is the frequency of the strike tone, $f_1$ is the frequency of the fundamental partial, $f_2$ is the frequency of the perfect fifth partial, and $f_3 \ldots f_n$ are the frequencies of any additional desired partials. For example, if one additional partial is desired, the resulting sequence of frequencies is $\{f, 3f/2, 2f\}$. In one embodiment of the invention, a fundamental partial at $f_1=C_3=130.8$ Hz and a perfect fifth partial at $f_2=G_3=196.2$ Hz yield a difference tone at $f_0=C_2=65.4$ Hz. The additional partial, if desired, would lie at $C_4=261.6$ Hz.

The precise size and shape of the bell is tuned to yield vibrational modes generating partials of the desired frequencies. In the preferred embodiment of the invention, the lowest partial is generated by the (2, 0) mode of vibration of the bell and the second-lowest partial is generated by the (3, 0) mode of vibration of the bell. In the preferred embodiment of the invention, the bell is tuned using an iterative optimization procedure in which the frequencies of the vibrational modes of each candidate design are calculated using a finite element analysis.

Specific techniques for iterative optimization of the bell size and shape are well known in the art. In the preferred embodiment of the invention, the sequence of frequencies described for FIG. 1 is tuned based on the method outlined in U.S. Pat. No. 6,915,756 to McLachlan et al., which patent is incorporated herein in its entirety this reference thereto. The final bell design is determined by iterative exploration of candidate designs. Each candidate bell design (i.e. a particular bell size and shape) of an axisymmetric, generally conical bell is defined by a point within a parameter space with dimensions of cone angle,
side length,
wall thickness,
wall taper, and
wall curvature.

The iterative optimization procedure proceeds by 1. setting the current bell design to an initial bell design;
2. selecting one of the partial frequencies to be tuned as a current objective;
3. selecting a desired value for the current objective;
4. modifying the current bell design in accordance with an optimisation method that moves the current value of the current objective towards the desired value;
5. repeating Step 4 until the current value of the current objective is substantially equal to the desired value (e.g. is within an allowable tolerance);
6. if the frequencies to be tuned do not match the desired sequence, selecting another one of the frequencies to be tuned as the current objective; and
7. repeating Steps 3-6 until the frequencies to be tuned are in the desired sequence.

In Step 4, the current value of the current objective (i.e. the frequency of the partial that is the current optimization target) is evaluated using a finite element analysis. Modification of the current bell design proceeds according to a method of gradient descent through the parameter space of candidate bell designs.

While the bell of the preferred embodiment of the invention is based on an axisymmetric, generally conical bell design, the invention is not limited to such bell geometries. Other bell geometries may be constructed using different parameter spaces without departing from the scope of the invention.

One skilled in the art will appreciate that it is impractical to tune a bell with infinite precision. In practice, each partial frequency within the desired series of partial frequencies can be attained to only a reasonable degree of precision. Herein, when a partial is stated to be at a frequency $f_0$, one skilled in the art will appreciate that this indicates that the frequency of the partial is substantially at $f_0$, falling within a range of possible values about a nominal value of $f_0$. For example, the actual value of the partial frequency f may lie within a range, $f_0\pm\epsilon f_0$ defined by a fractional tolerance $\epsilon$. For example, for a tolerance of $\epsilon=1\%$, the actual value of the partial frequency fall in the range $f_0\pm0.01\ f_0$. Tolerances of 0.1%, 1%, 5%, and other values are possible without departing from the scope of the invention.

Although the invention is described herein with reference to several embodiments, including the preferred embodiment, one skilled in the art will readily appreciate that other applications may be substituted for those set forth herein without departing from the spirit and scope of the invention.

Accordingly, the invention should only be limited by the following Claims.

The invention claimed is:

1. A bell with a sequence of partials, comprising:

a lowest partial substantially at frequency f, and a second-lowest partial substantially at frequency 3f/2, wherein said lowest partial and said second-lowest partial generate a subharmonic difference tone substantially at frequency f/2, and wherein said subharmonic difference tone is perceived as a strike tone of said bell that is characteristic of a strike tone that is produced by a conventional bell having a characteristic height or diameter dimension that is substantially larger than that of said bell.

2. The bell of claim 1, with one or more additional partials substantially spaced at a frequency interval of f/2 above said second-lowest partial.

3. The bell of claim 1, wherein f=130.8 Hz.

4. A bell with a sequence of partials, comprising:

a lowest partial with a frequency within a range f±Ef, and a second-lowest partial with a frequency within a range 3f/2±E(3f/2), wherein E is a fractional tolerance, wherein said lowest partial and said second-lowest partial generate a subharmonic difference tone substantially at frequency f/2, and wherein said subharmonic difference tone is perceived as a strike tone of said bell that is characteristic of a strike tone that is produced by a conventional bell having a characteristic height or diameter dimension that is substantially larger than that of said bell.

5. The bell of claim 4 wherein E has a value between 0.001 and 0.05.

6. A method of tuning a bell having a sequence of partials, comprising the steps of:

selecting a desired strike tone frequency f/2, tuning the frequency of the lowest partial substantially at frequency f, and tuning the frequency of the second-lowest partial substantially at frequency 3f/2, wherein said lowest partial and said second-lowest partial generate a subharmonic difference tone substantially at said strike tone frequency, and wherein said subharmonic difference tone is perceived as a strike tone of said bell that is characteristic of a strike tone that is produced by a conventional bell having a characteristic height or diameter dimension that is substantially larger than that of said bell.

7. The method of claim 6, additionally comprising the steps of:

tuning one or more additional partials substantially spaced at a frequency interval of f/2 above said second-lowest partial.

8. The bell of claim 6, wherein f=130.8 Hz.

9. A method of tuning a bell having a sequence of partials comprising the steps of:

selecting a desired strike tone frequency f/2, tuning the frequency of the lowest partial to be within a range f±Ef, and tuning the frequency of the second-lowest partial to be within a range 3f/2±E(3f/2), wherein E is a fractional tolerance, wherein said lowest partial and said second-lowest partial generate a subharmonic difference tone substantially at said strike tone frequency, and wherein said subharmonic difference tone is perceived as a strike tone of said bell that is characteristic of a strike tone that is produced by a conventional bell having a characteristic height or diameter dimension that is substantially larger than that of said bell.

10. The method of claim 9 wherein E has a value between 0.001 and 0.05.

* * * * *